US006128878A

United States Patent [19]

Erickson

[11] Patent Number: 6,128,878

[45] Date of Patent: Oct. 10, 2000

[54] PORTABLE STORAGE BUILDING WITH CONCRETE FLOOR AND METHOD OF ASSEMBLING AND MOVING SAME

[76] Inventor: Dayle Eugene Erickson, 1267 Neola Ave., Suite 1300, Jefferson, Iowa 50129-7000

[21] Appl. No.: 09/075,111

[22] Filed: May 8, 1998

[51] Int. Cl.[7] ..... E04B 1/14

[52] U.S. Cl. ..... 52/319; 52/335; 52/414; 52/338; 249/13; 249/18; 249/21

[58] Field of Search ..... 52/319, 335, 338, 52/414; 249/13, 18, 21, 28, 35, 43, 191, 219.1

[56] References Cited

U.S. PATENT DOCUMENTS

| | | | |
|---|---|---|---|
| 1,472,174 | 10/1923 | Hughes | 249/35 |
| 1,968,189 | 7/1934 | Bartels | 249/18 |
| 2,101,019 | 12/1937 | Bowes | 249/18 |
| 2,306,548 | 12/1942 | Leemhuis | 249/13 |
| 2,886,876 | 5/1959 | Wilson | 249/13 |
| 3,327,997 | 6/1967 | Zenke . | |
| 3,382,637 | 5/1968 | Longinotti | 52/338 |
| 3,778,953 | 12/1973 | Delorean . | |
| 4,151,694 | 5/1979 | Sriberg et al. | 52/335 X |
| 4,327,529 | 5/1982 | Bigelow, Jr. et al. . | |
| 4,333,280 | 6/1982 | Morton | 52/414 X |
| 4,432,175 | 2/1984 | Smith . | |
| 4,653,237 | 3/1987 | Taft | 52/335 |
| 4,722,155 | 2/1988 | Ericsson . | |
| 5,111,628 | 5/1992 | Desjoyaux et al. | 249/13 X |
| 5,167,842 | 12/1992 | Vercelletto . | |
| 5,285,604 | 2/1994 | Carlin . | |
| 5,461,832 | 10/1995 | Smith . | |
| 5,493,817 | 2/1996 | Speer . | |
| 5,544,464 | 8/1996 | Dutil | 52/335 X |
| 5,590,493 | 1/1997 | Wilson | 249/18 X |

*Primary Examiner*—Carl D. Friedman
*Assistant Examiner*—Phi Dieu Tran A
*Attorney, Agent, or Firm*—Zarley, McKee, Thomte, Voorhees & Sease

[57] ABSTRACT

A concrete floor of a portable storage building is made for one or more storage units with each unit including a floor made through use of a single pair of mold sections or a plurality of pairs of mold sections interconnected for multiple storage units. Each mold section has a raised center and a circumferencial channel with concrete being poured onto the raised center and into the circumferencial channel. Removable exterior mold side walls complete the floor mold. A jack bracket is removably attachable to the floor corners and in turn is engageable with a hydraulic jack for raising and lowering the floor for loading onto the flatbed of a truck for transport to a remote site of use. A chain hoist connected to a top edge of a building wall panel is used to pivot the wall panel to a raised vertical position as the hoist moves on a rail to the vertical plane of the wall panel when raised.

12 Claims, 14 Drawing Sheets

36
38
40
16
16A
18
56
74
7-7

III
III
VI
VI
VII
VII
38
40
42
44
46
48
50
52
54
56
58
60
62
64
66
68
70
72
74
76
78
80
82
84
86
88
90
92
94
96
98
100
102
104
106
108
110
112
114
116

62
62
40
56
58
64
66
68
70
72
74
76
78
80
82
84
86
88
90
92
94
96
98

PORTABLE STORAGE BUILDING WITH CONCRETE FLOOR AND METHOD OF ASSEMBLING AND MOVING SAME

BACKGROUND OF THE INVENTION

Rental storage buildings are available in many cities at centralized locations for people to bring their items to be stored away from their own premises. While this approach for temporary storage has been reasonably successful, what is needed is a portable building having a concrete floor which may be factory manufactured but is capable of being delivered to the home or business of the party needing additional storage space.

SUMMARY OF THE INVENTION

There are several features to this invention that cooperate to make factory fabrication of portable buildings having concrete floors practical for delivery to the location where the buildings will be used. The first feature is the metal mold for the concrete floor is in sections which may be interconnected to provide a floor of any desired length. Each mold section includes a raised center relative to an outer channel which extends around each center section. The channel has a vertical exterior flange to which the mold sections are connected together along their adjacent sides, or removable end and side plates are attached which are removed when the poured concrete has set.

The channel at the ends of each mold section includes a pair of sleeves which become embedded in the poured concrete and receive lift pins. These lift pins connect jacks to the floor after the mold end walls have been removed thereby allowing the building including the floor, to be raised for a truck flatbed to be moved thereunder such that the portable building may be transported.

The lift pin sleeves are connected to L-shaped reinforcing rod brackets which extend the length of the channel to reinforce the poured concrete. A sleeve extends in the channel between mold sections to interconnect removable walls at opposite ends of the mold sections. While the concrete is being poured a rod extends in these sleeves to interconnect the opposite mold section end walls.

The mold section removable side walls also include a horizontally inwardly extending flange to which a removable building wall base plate is attached for being anchored in concrete to provide a ledge for the bottom edge of the building end wall.

The removal of the concrete floor from the mold is accomplished through use of lifting brackets at oppositely disposed front and back sides of the floor which engage the floor through the lift pins received in sleeves embedded in the concrete channels. Hydraulic jacks engage the removable lift brackets for raising and lowering the floor in the factory and at the job site when being put on or removed from a truck flatbed. Hydraulic circuitry for the jacks is provided which equalizes the lifting action of each jack such that the raising and lowering is uniform at each jack, keeping the floor level. The lift bracket is L-shaped and may have attached to the horizontal leg of the bracket, a caster allowing the floor to be moved about on the casters.

Erection of the building front wall may be accomplished through the use of a pair of hoists moveable on rails supported on standards supported on the horizontal legs of the lift brackets. A wall is laid across the building floor with the lower most wall edge being positioned on a ledge below the top surface of the floor extending along the forward edge of the concrete floor.

The hoists are attached to the opposite (upper) wall edge.

Operation of the hoist to pivot the wall occurs with the hoist moving along the rail toward the vertical plane of the wall when erected.

It is thus seen that the concrete floor is easily fabricated, walls erected and attached with the completed building being raised by the jacks through use of the removable jack brackets such that after the metal floor mold has been removed from under the floor a flatbed truck can be moved under the building for transport to the location where the building will be used. The storage building may have any number of units each with its own garage-type door. Each unit has a concrete floor formed through the use of two mold sections.

DESCRIPTION OF THE DRAWINGS

FIG. 19 is fragmentary perspective view of the jack assembly connected to the lift bracket in turn connected to the concrete floor for raising and lowering the concrete floor.

FIG. 20 is a cross sectional view taken along line 20—20 in FIG. 19.

DESCRIPTION OF THE PREFERRED EMBODIMENT

Figure 1:
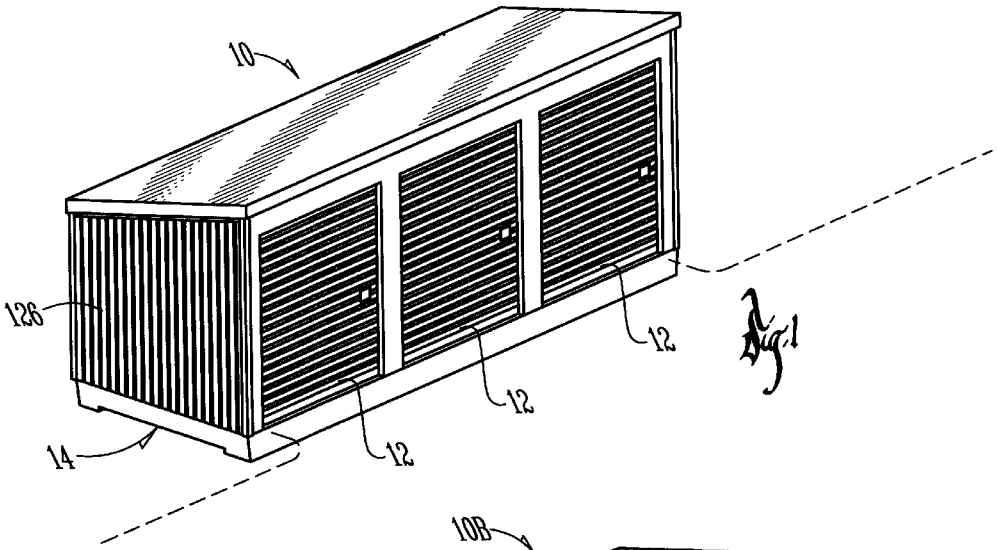
FIG. 1 is a perspective view of a completed portable three-unit storage building with concrete floor comprising three pairs of floor sections.
Figure 3:
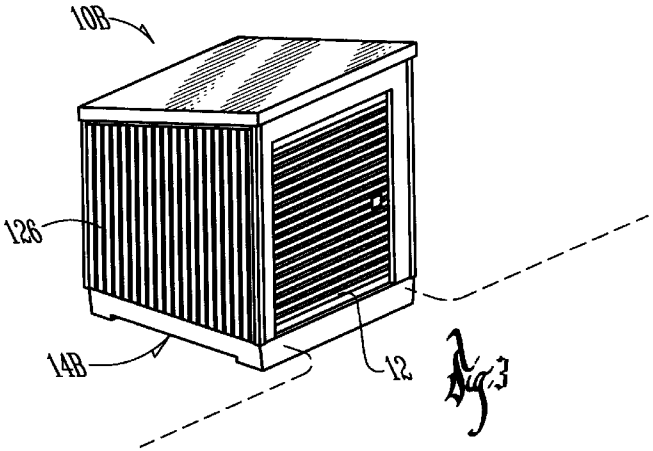
FIG. 3 is a view similar to FIGS. 1 and 2 but showing a one-unit portable storage building.
Figure 2:
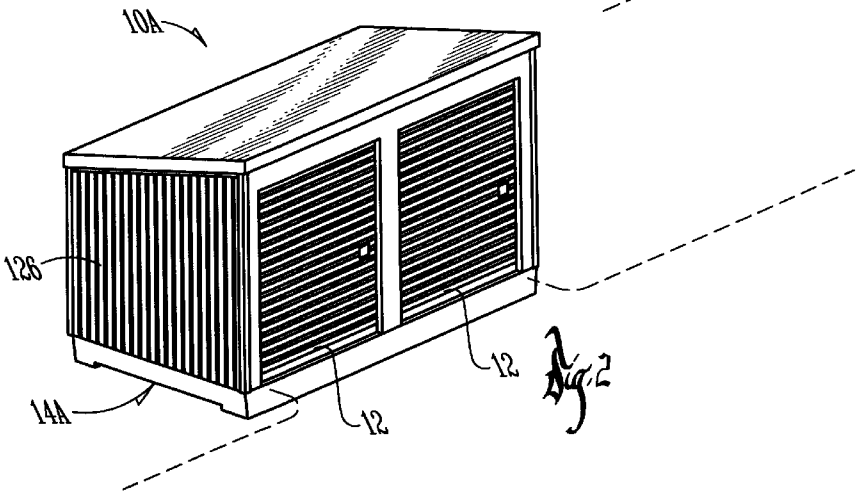
FIG. 2 is a view similar to FIG. 1 but showing a two-unit portable storage building.
Figures 4, 5:
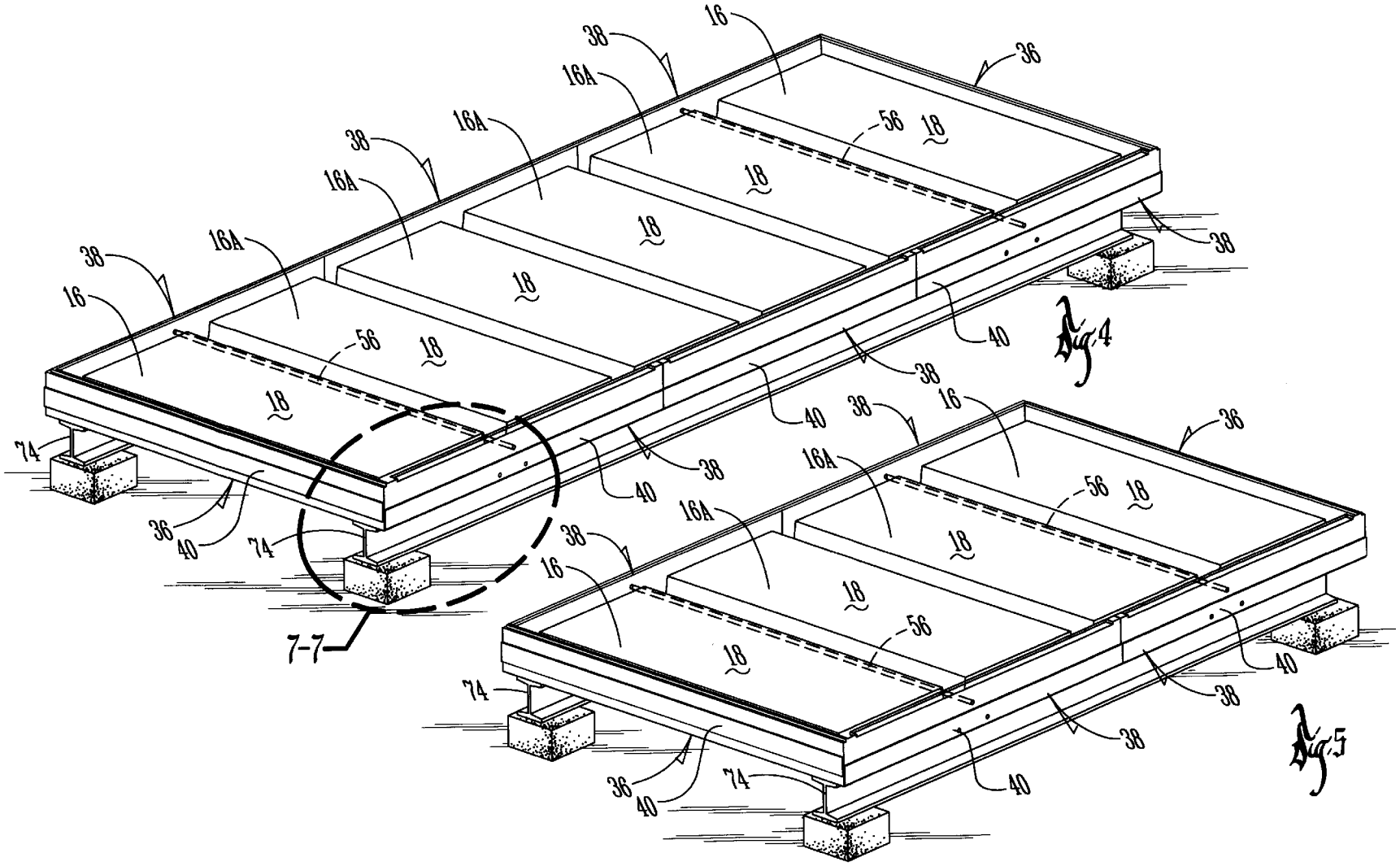
FIG. 4 is a perspective view of six mold sections interconnected for fabricating a three-unit portable building.
FIG. 5 is a view similar to FIG. 4 but showing four mold sections interconnected for manufacture of a two-unit portable storage building.
Figure 12:
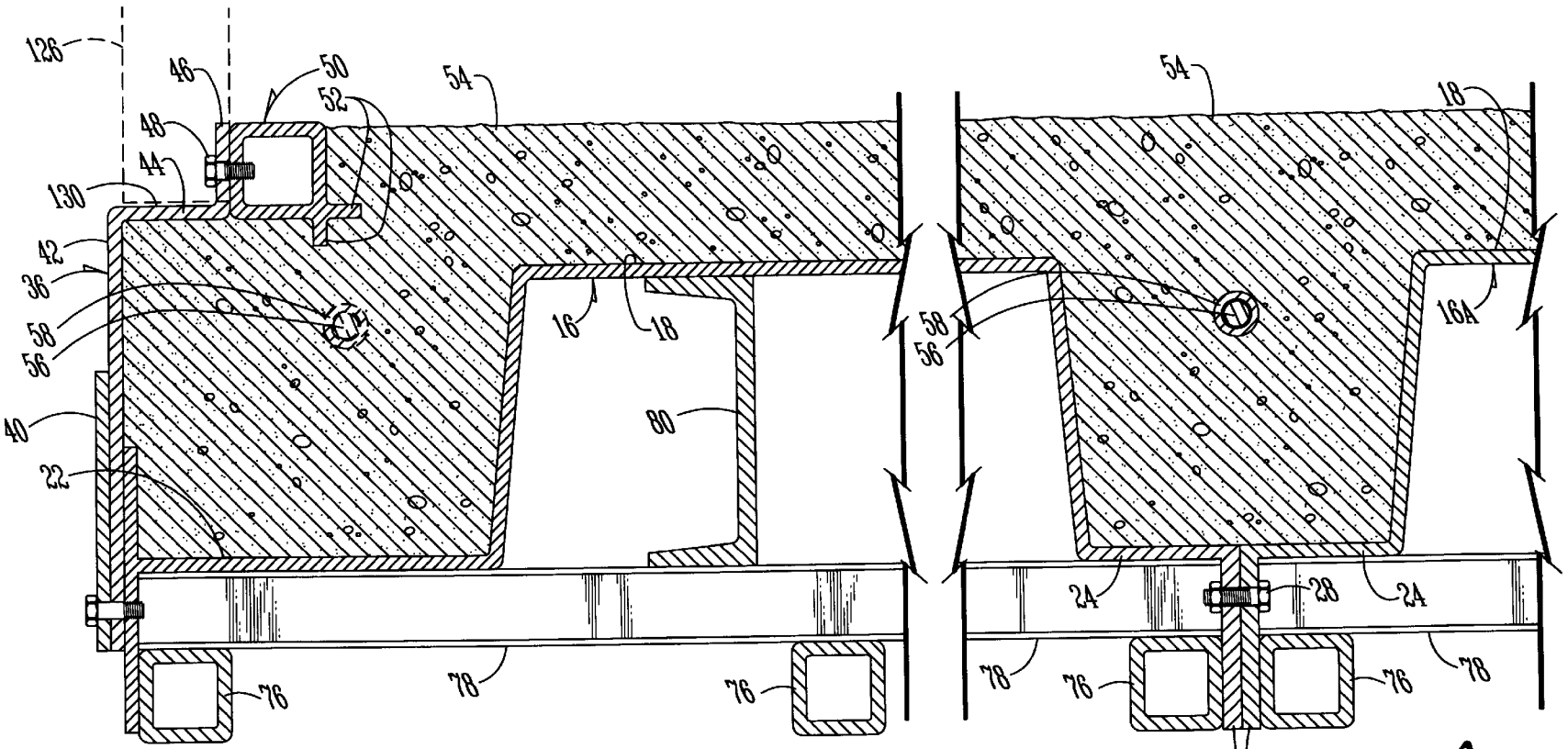
FIG. 12 is a fragmentary cross sectional view taken along line 12—12 in FIG. 11.
Figure 13:
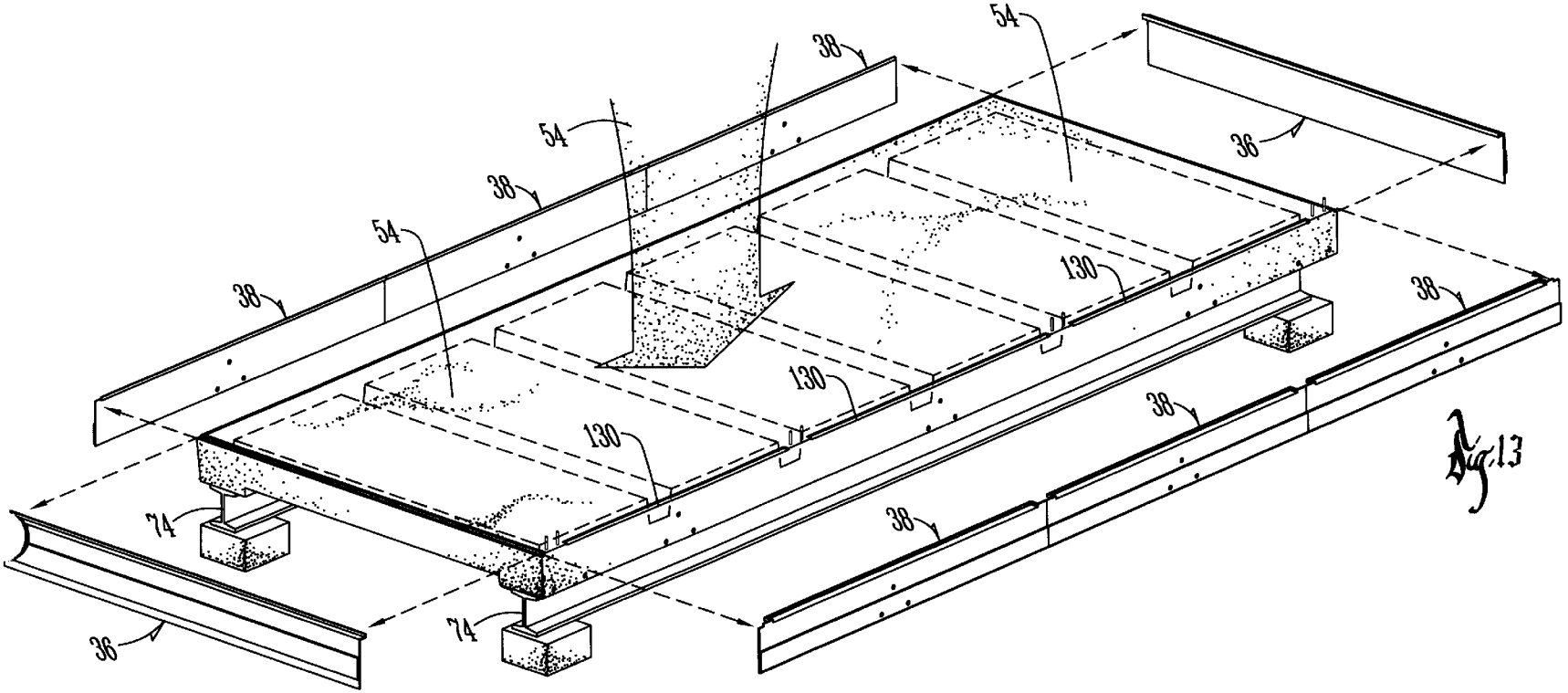
FIG. 13 is a perspective view similar to FIG. 4 but showing the exterior vertical mold walls removed after the concrete has been poured and hardened.
Figures 14, 15:
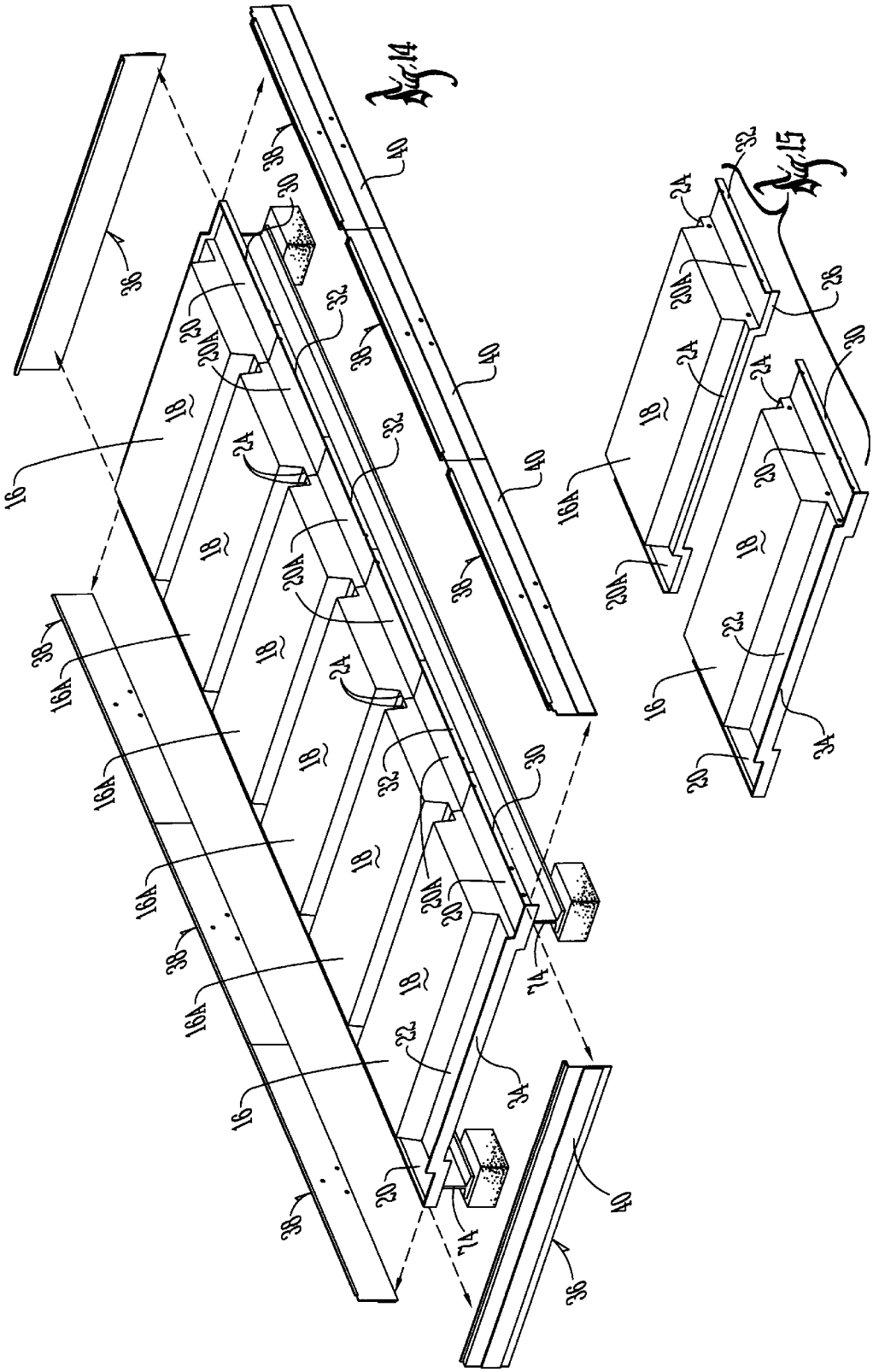
FIG. 14 is a perspective view similar to FIGS. 4 and 13 showing the peripheral mold walls in an exploded relationship to the interconnected mold sections prior to being attached and concrete being poured.
FIG. 15 is a perspective view of a pair of mold sections which are used as needed to manufacture the floor size desired with one section being for the floor end and the other sections being used between the end floor sections.
Figure 17:
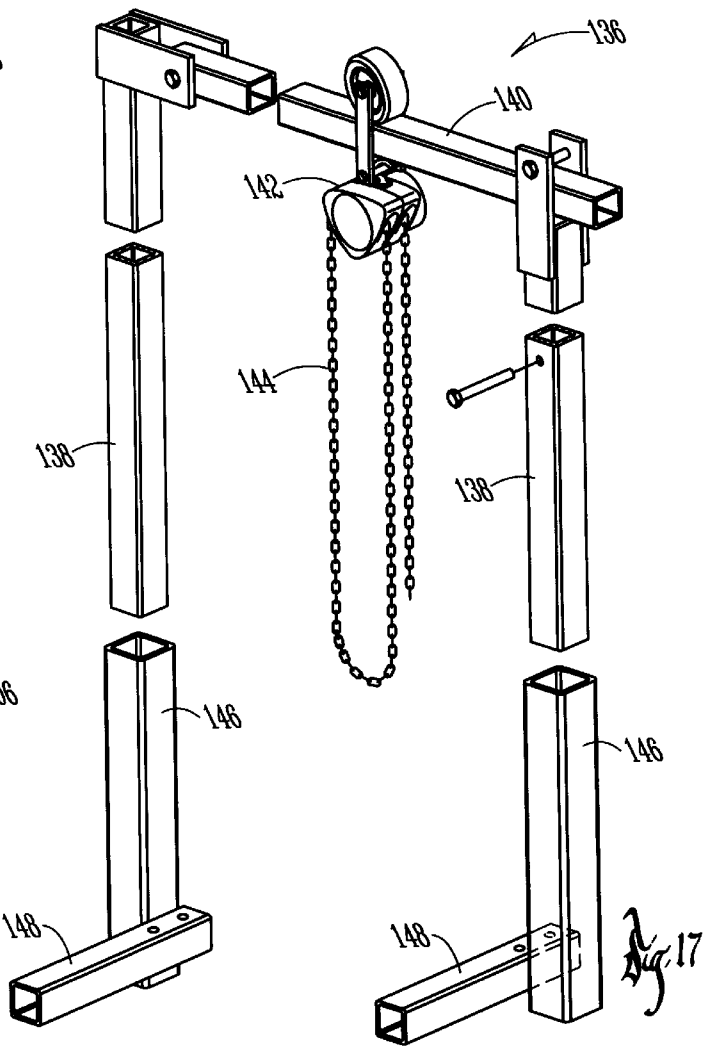
FIG. 17 is a fragmentary perspective view of the hoist assembly.

The portable storage building of this invention is referred to generally in FIG. 1 by the reference numeral 10 and is seen to include three storage units 12. In FIG. 2 a portable storage building 10A is shown using two storage units 12 while in FIG. 3 single storage unit 12 is used for the portable building 10B. The portable building 10 includes a concrete floor 14 which is made using six bottom wall mold sections 16 and 16A as seen in FIGS. 14 and 15. The bottom wall mold sections 16 are used at the ends of the building 10 while the mold sections 16A are used in between the ends of bottom wall mold section 16. Each of the mold sections include a raised central wall 18 with channels 20 and 20A at opposite ends. A full width channel 22 is formed on the outer side of mold section 20 while a half channel 24 is formed on the inner side which cooperates with a half channel 24 on the mold section 16A to form a full channel therebetween. As seen in FIG. 12 the walls forming the channels 24 include downwardly extending flanges 26 interconnected by bolts 28 to provide a unitary floor mold.

The ends of each mold section 16 and 16A include upstanding vertical flanges. The outer side of the mold section 16 includes a flange 34 to which a mold removable side wall 36 is attached. The end flanges 30 and 32 provide means for connecting the mold end wall panels 38 each of which extend the width of two mold sections 16 and 16A. A strengthening plate 40 is provided on the mold end wall panels 36 and side wall panels 38.

The mold panel 38 as seen FIG. 12 includes a vertical wall 42 and a horizontal wall 44 which merges at a right angle into a vertical wall 46 which is fastened by a bolt 48 to a floor plate anchor tube 50 which functions as a base plate for a building end wall. The anchor tube 50 includes a pair of edge portions 52 extending at right angles to each other which are embedded into the poured concrete 54 making the base plate 50 an integral part of the concrete 54. When the concrete 54 has set the bolts 48 are removed along with the mold panels 36.

Figures 6, 7:
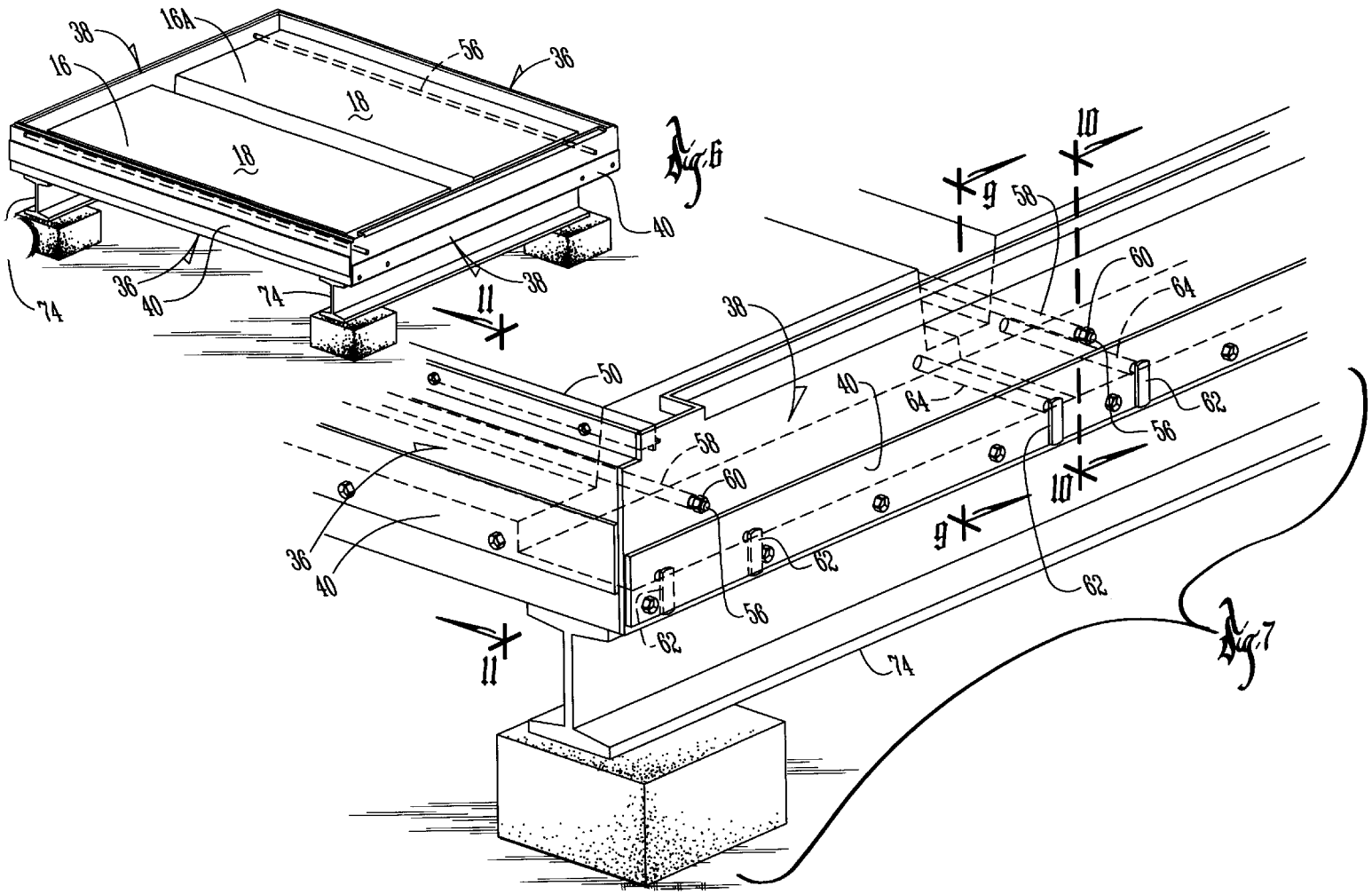
FIG. 6 is a perspective view similar to FIGS. 4 and 5 but showing two mold sections interconnected for manufacture of a one-unit portable storage building.
FIG. 7 is a fragmentary perspective view of the floor metal mold as indicated by the line 7—7 in FIG. 4.
Figure 8:
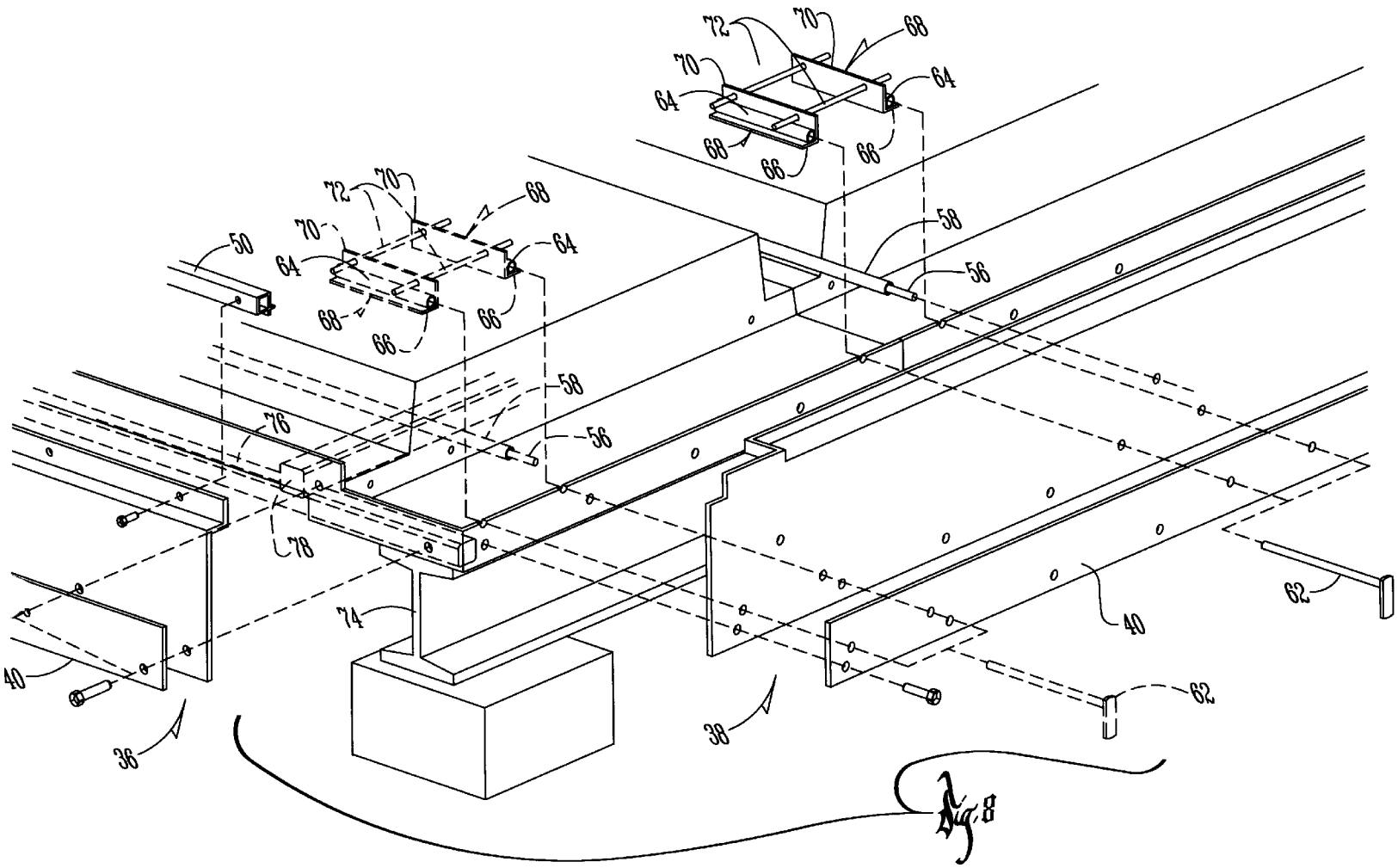
FIG. 8 is an exploded fragmentary perspective view of the metal mold as seen in FIG. 7.

As seen in FIGS. 7 and 8 the mold end wall panels 38 are interconnected by a rod 56 extending through a tube 58. A nut 60 engages the outer surface of the mold end wall panels 36 to lock them together while the concrete is being poured and sets.

Figure 10:
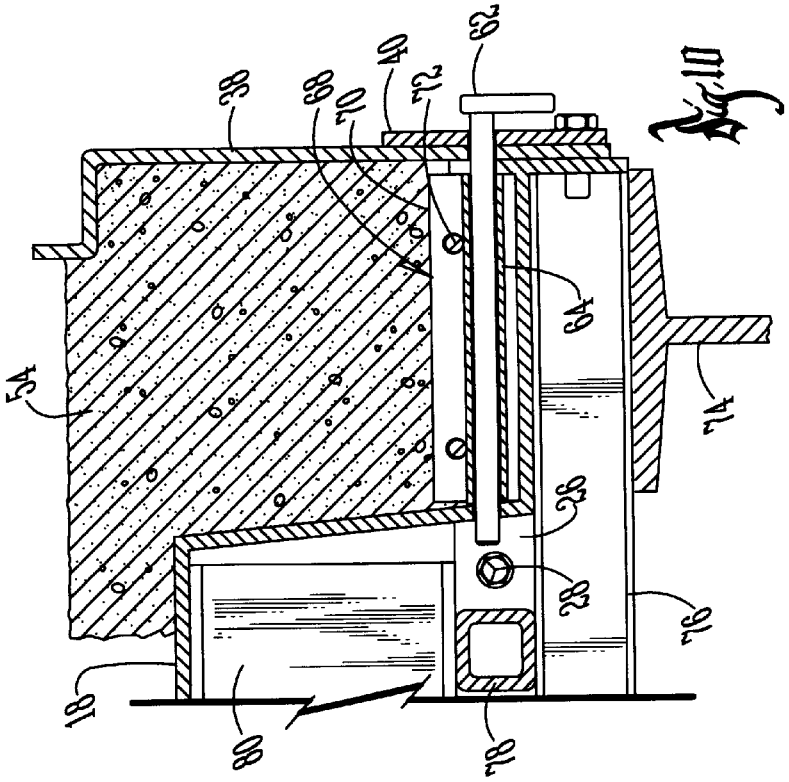
FIG. 10 is a cross sectional view taken along line 10—10 in FIG. 7.
Figure 9:
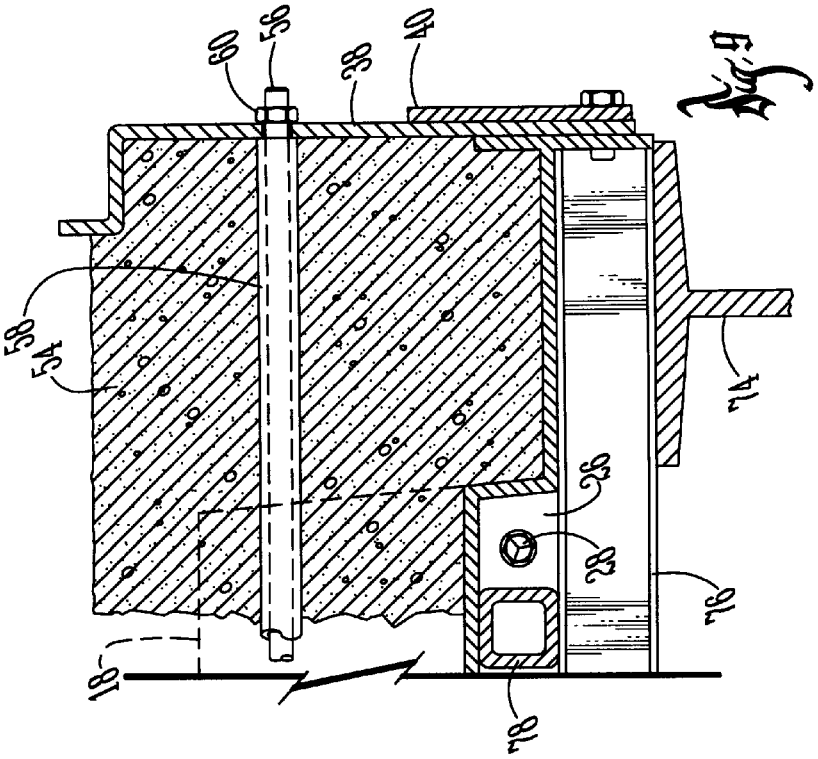
FIG. 9 is a cross sectional view taken along line 9—9 in FIG. 7.
Figure 11:
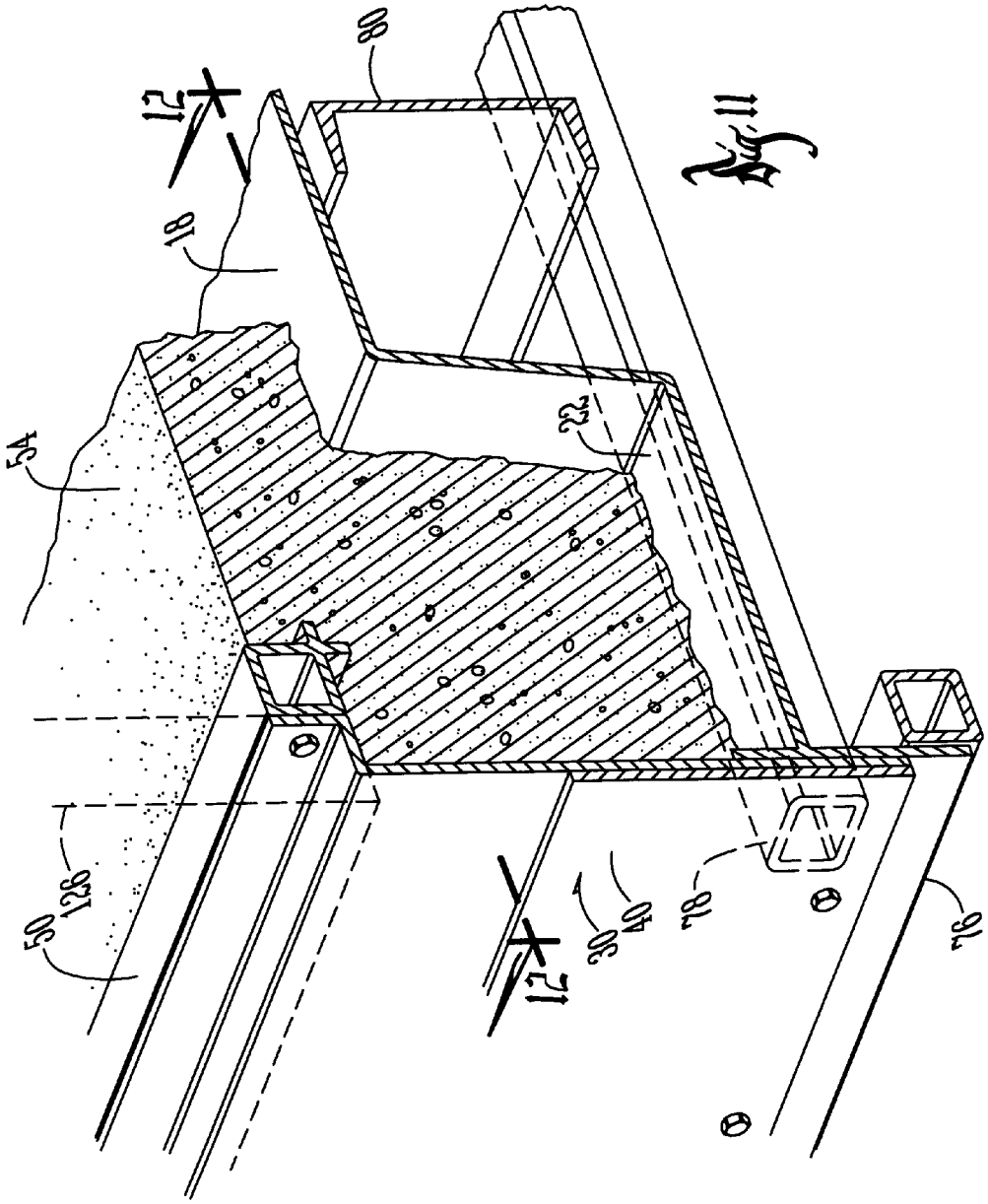
FIG. 11 is a fragmentary cross sectional perspective view taken along line 11—11 in FIG. 7.

Alignment pins 62 are seen in FIGS. 8 and 10 and are received in sleeves 64 welded to the horizontal leg 66 of L-shaped brackets 68 having vertical legs 70 through which reinforcing rods 72 extend at right angles to the sleeves 64. All of these components are embedded in the concrete 54 as seen in FIG. 10 and once the concrete is set the alignment pins 62 are removed.

The assembled mold is supported by four sets of support members each extending at right angles to the next adjacent set. As seen in FIG. 10 an I-beam 74 supports a cross member 76 which in turn supports cross member 78 on which cross member 80 rests which in turn is positioned under the raised central wall 18.

Figure 16:
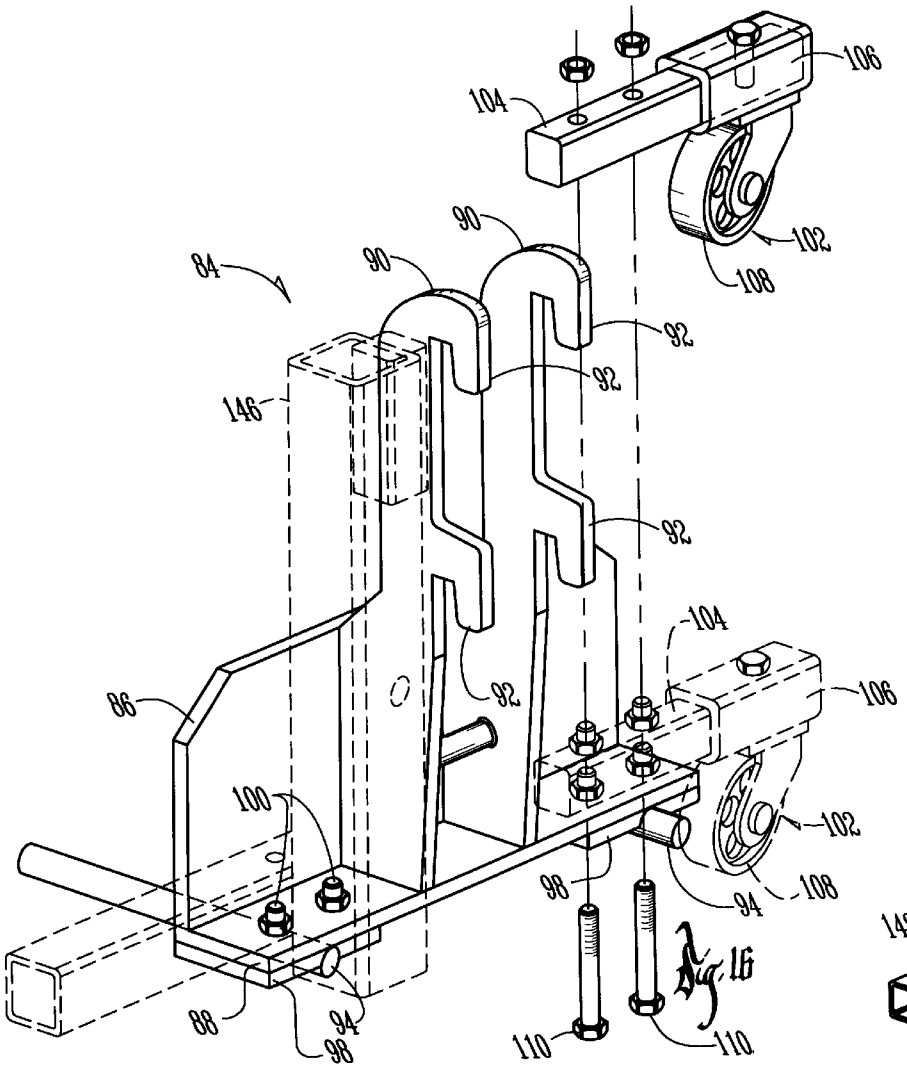
FIG. 16 is a fragmentary perspective view of the lifting bracket assembly.

Jack assemblies 82 having double acting cylinders as seen in FIGS. 18–22 are provided two on each side of the floor and are connected to the concrete floor through lifting bracket assemblies 84 as seen in FIG. 16.

A lifting bracket 84 includes a vertical leg 86 and a horizontal leg 88 to which a pair of spaced apart vertical lift plates 90 are welded having downwardly facing hooks 92. A pair of lift rods 94 are provided which are received in sleeves 64 as seen in FIG. 20. The lift rods 94 are clamped to the horizontal leg 88 by plate 98 locked to thereto by bolts 100.

A caster assembly 102 is fastened to the horizontal leg 88 by a shaft member 104 telescopically received in a tube 106 to which a caster 108 is mounted. Bolts 110 secure the clamping plate 98 and the shaft 104 to the horizontal leg 88. The casters allow the concrete floor to be moved about on the factory floor.

The jack assembly 82 includes a hydraulic cylinder to which a plurality of transversely extending plates 112 are connected for engagement with the hooks 92 on the lifting bracket 84. A pair of vertically disposed plate elements 114 interconnect the outer free ends of the plates 112 as seen in FIG. 19.

Figure 22:
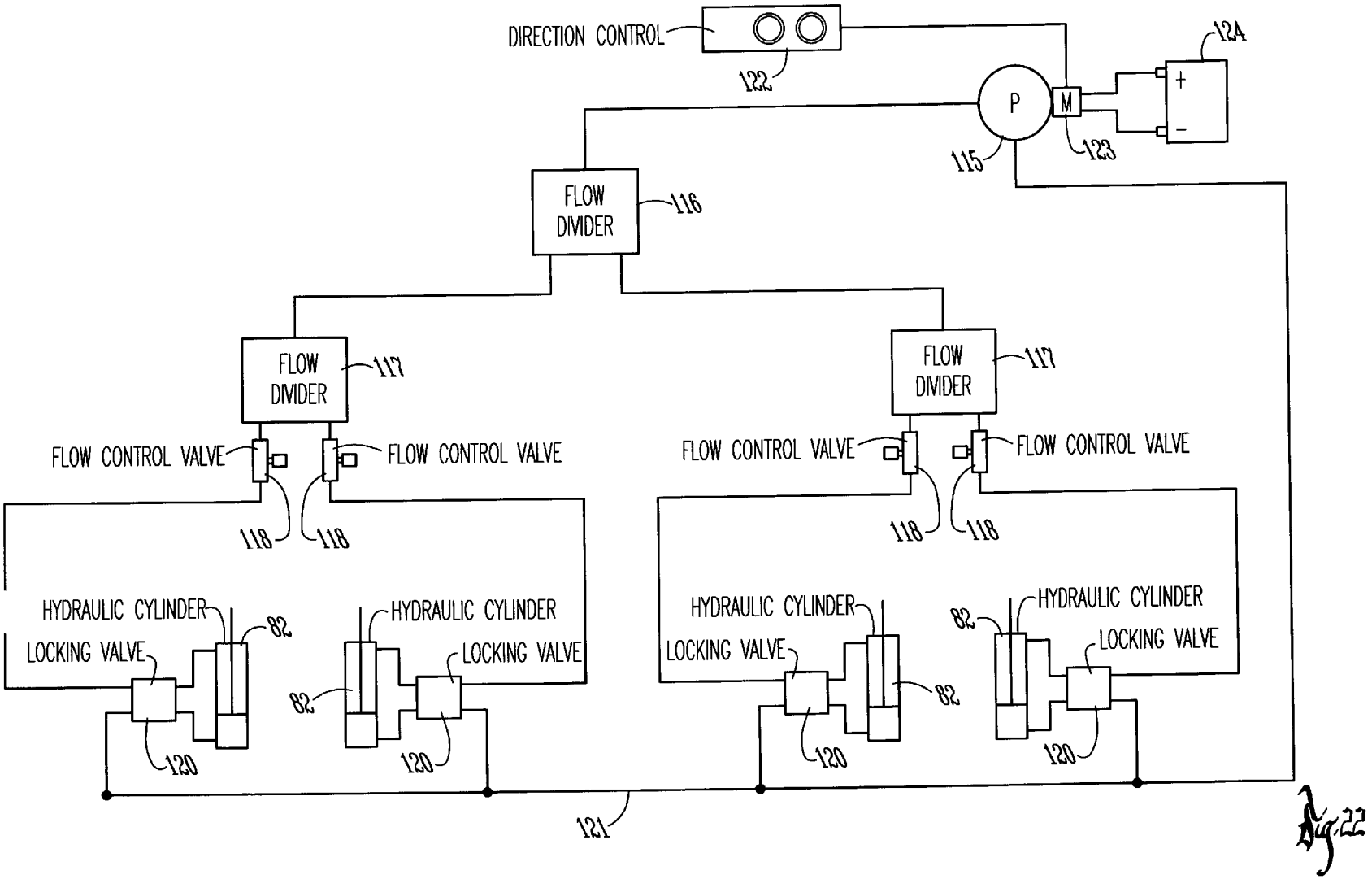
FIG. 22 is a hydraulic circuitry schematic for the jack assemblies which provide for uniform lifting and lowering by providing flow equalization at each jack assembly.

In FIG. 22 a pump 115 operates the four jacks 82 and their double-acting hydraulic cylinders through a flow divider 116 in turn connected to flow dividers 117 which divide the hydraulic fluid flow through flow control valves 118. Locking values 120 are provided between the flow control valves 118 and the hydraulic cylinders 82. A return line 121 is connected to each of the locking valves 120 and the pump 115. An up and down direction control 122 is connected to a D.C. motor 123 in turn connected to a battery electrical power source 124. It is seen that this circuitry insures that the storage building 10 is raised and lowered in a level manner. The primary components of the circuitry are commercially identified as follows:

| | |
|---|---|
| Pump 115 | Fenner DC 70 BSR 42 |
| Flow dividers 117 | Fenner FD 204A |
| Flow control Valve 118 | Park Fluid Power Part F6005 |
| Locking valve 120 | Gresen Part LOA-25-D |

Figure 18:
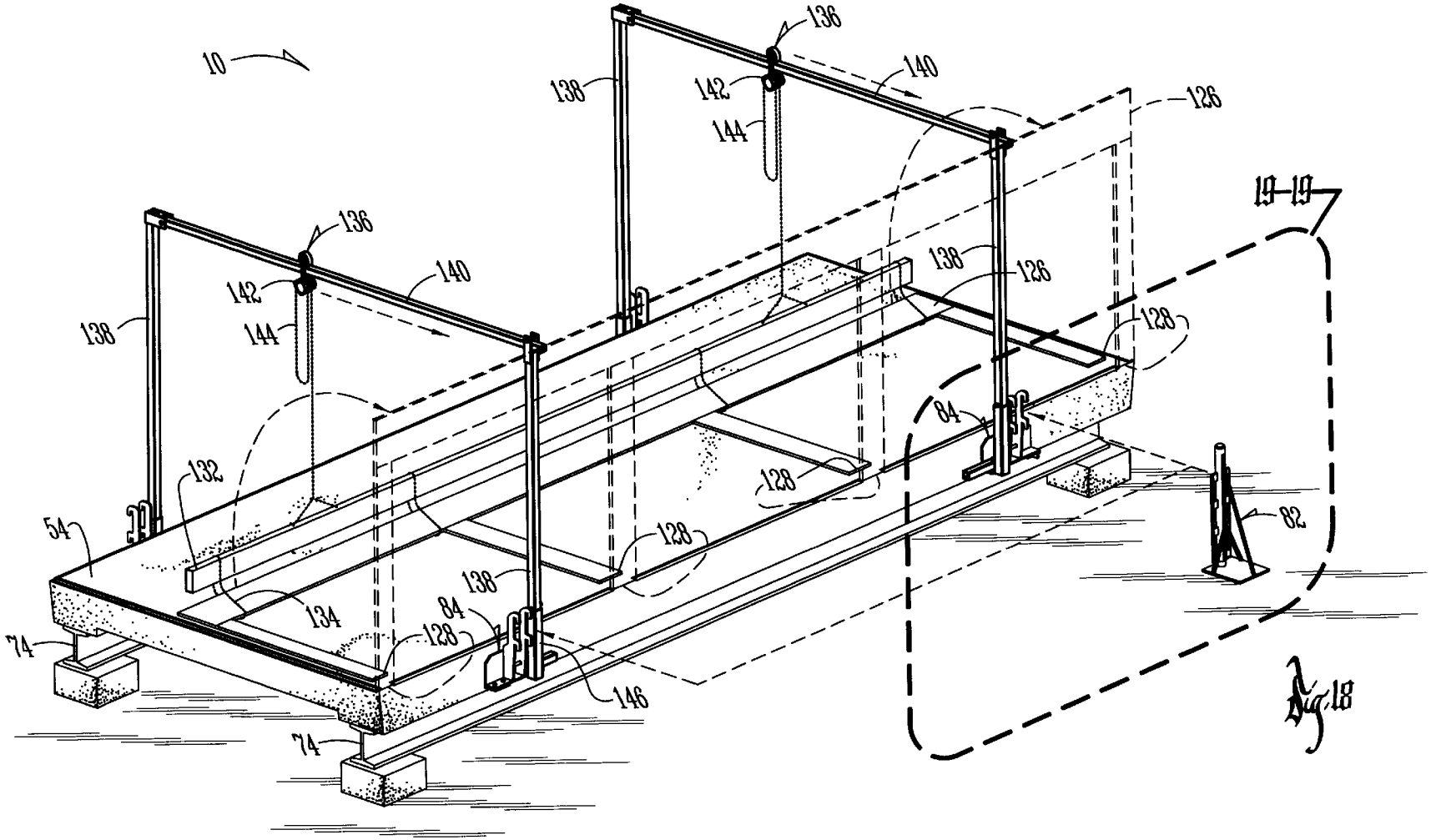
FIG. 18 is a perspective view of the pair of hoist assemblies mounted over the concrete floor for use in erecting the forward building wall panel.
Figures 12, 13:
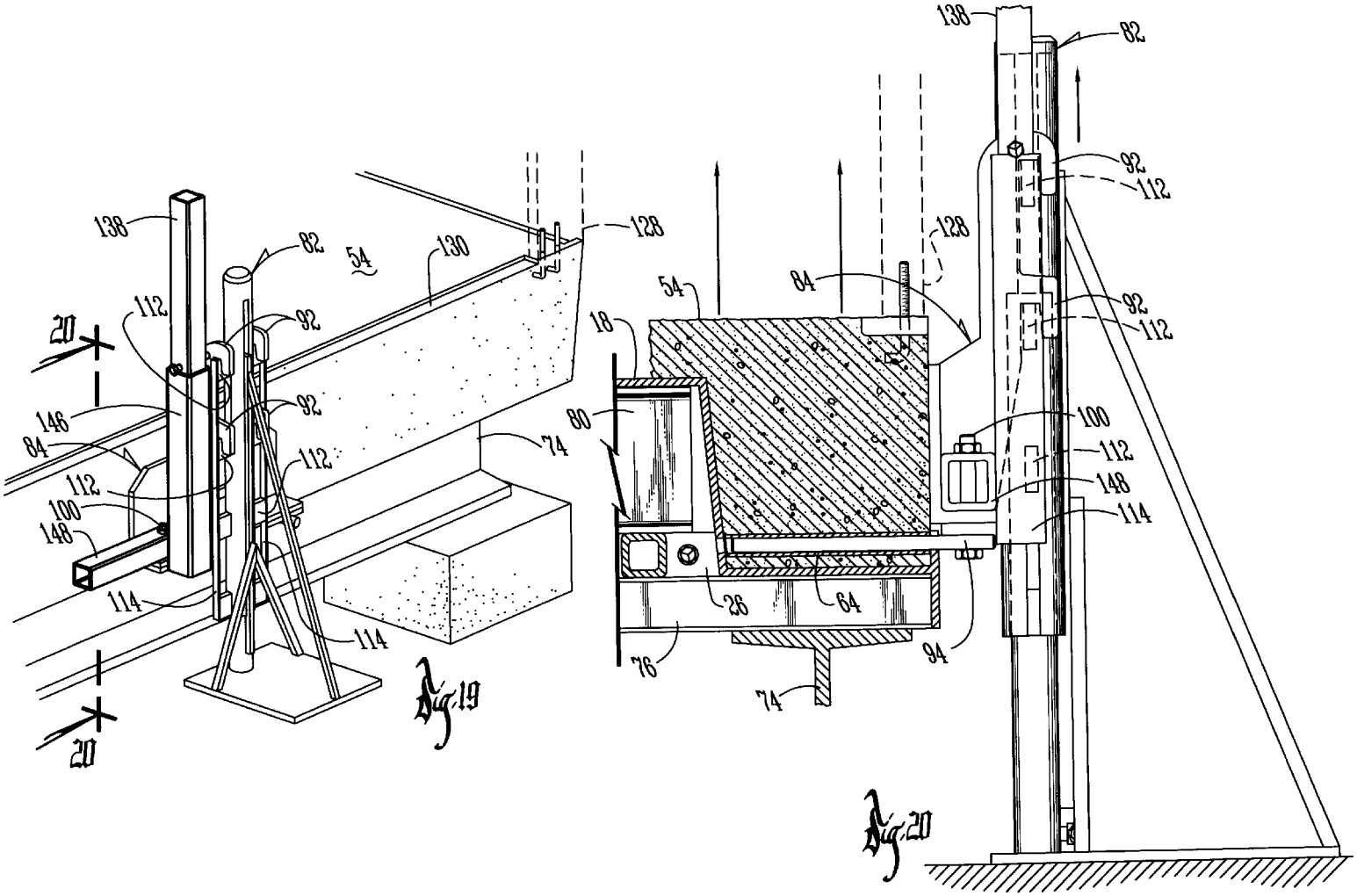

After the concrete 54 is set and the mold has been removed the exterior walls of the building 10 may be erected as seen in FIG. 18. The building 10 includes a long front wall 126 which is laid flat on the concrete floor with its bottom edge 128 being placed in the vertical plane of the concrete ledge 130. A lift bar 132 is connected to the upper edge of the wall panel 126 through chains 134. A pair of hoist assemblies 136 are provided including oppositely disposed standards 138 interconnected by a rail 140 which supports a trolley 142 to which a chain hoist 144 is carried. The lower ends of the standards 138 are received in sleeves 146 which include horizontally disposed foot tubes 148 resting on the horizontal leg 88 of disposed foot tubes 148 resting on the horizontal leg 88 of the lifting bracket 84 and secured thereto by the bolts 100 as seen in FIGS. 16 and 19.

Thus, it is seen the operation of the chain hoist 144 causes the upper end of the wall panel 126 to be raised pivoting the wall panel about its lower forward edge 128 as the hoist 144 moves on the trolley 142 toward the vertical plane of the wall panel 126 when in its raised vertical position as seen in FIG. 18.

Figure 21:
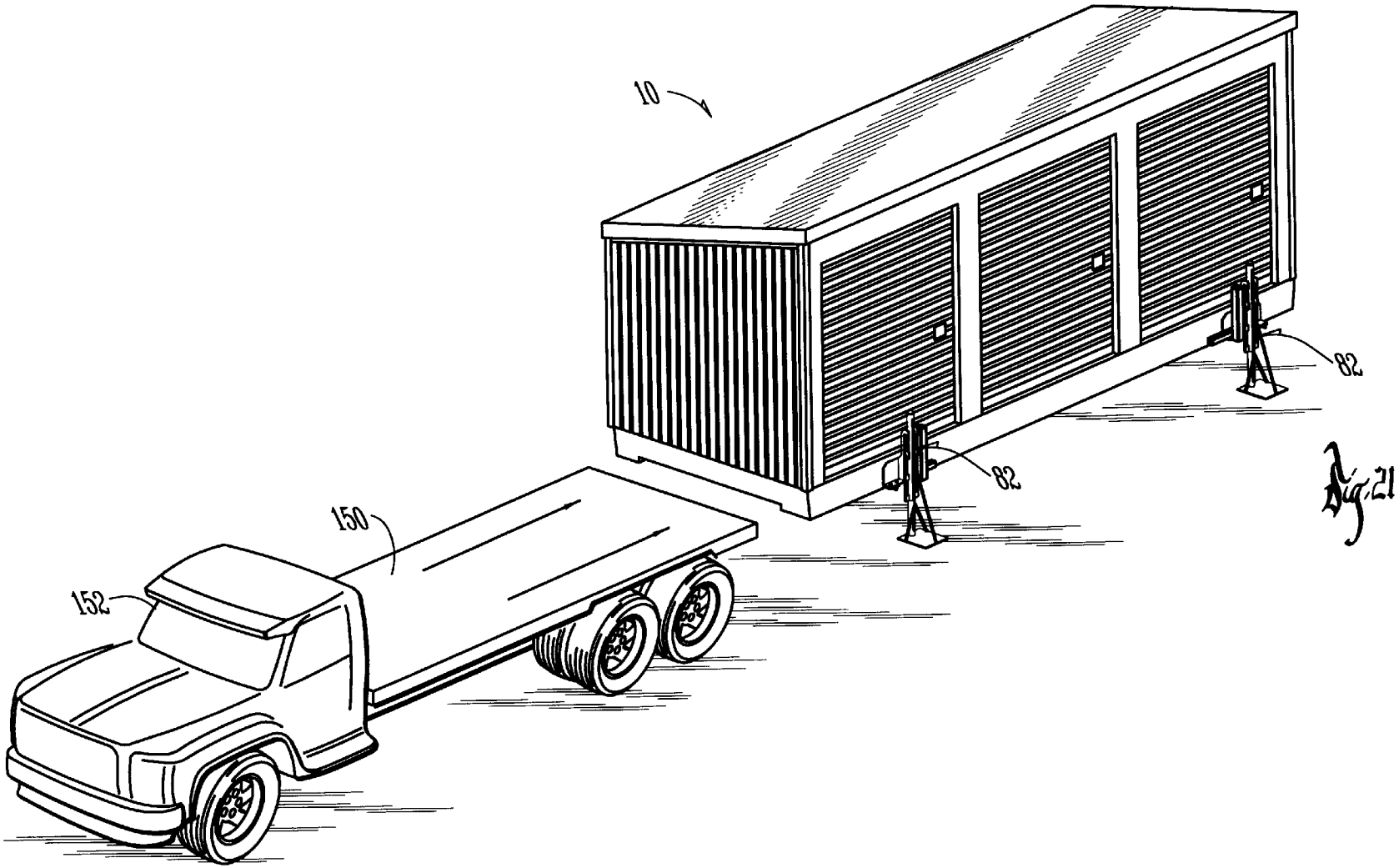
FIG. 21 is a perspective view of the completed portable storage building raised by jacks ready for a flatbed truck to be positioned under it for delivery to a use site.

The portable building 10 of FIGS. 1 and 21 includes three bay units and has overall measurements of 10 feet by 24 feet with each bay unit being 8'×10' and having 6'6" wide and 6'8" high doors.

It is seen in FIG. 21 that the floor mold has been disassembled and removed from under the building floor and that through the use of the jacks 82 the portable storage building 10 may be raised high enough that the flatbed 150 of the truck 152 may be backed under the building with the jacks lowering the building onto the flatbed 150 for transport to a remote site of use. The building would then be unloaded at the site of use and should it ever be desirable to move it again the jacks would be reused to lift it up for being loaded on the flatbed 150.

What is claimed is:

1. A moveable building concrete floor mold comprising, at least two bottom wall mold sections of sheet metal for forming said concrete floor having opposite ends and sides, at least one of said opposite sides of one of said bottom wall mold sections being connected to the corresponding opposite side of said other bottom wall mold section to form a multiple bottom wall section floor mold, each of said bottom wall mold section including a horizontal outwardly extending channel wall extending around a raised central wall with said channel wall and said central wall adapted to receive poured concrete, and said channel wall including an outer peripheral edge having a vertical fastening flange, said vertical fastening flange comprising means for connecting at least one of said opposite sides of one of said bottom wall mold sections to the corresponding opposite side of said other bottom wall mold section to form said multiple bottom wall section floor mold.

2. The moveable building concrete floor mold of claim 1 and removable end walls are attached to said vertical flanges along said opposite ends of said bottom wall mold section.

3. The moveable building concrete floor mold of claim 1 wherein said vertical fastening-flange extends downwardly below said channel wall.

4. A moveable building concrete floor mold comprising, at least one bottom wall mold section of sheet metal for forming said concrete floor having opposite ends and sides, at least one of said opposite sides being adapted to be connected to the corresponding opposite side of another bottom wall mold section to form a multiple bottom wall section floor mold, said bottom wall mold section including a horizontal outwardly extending channel wall extending around a raised central wall with said channel wall and said central wall adapted to receive poured concrete, said channel wall including an outer peripheral edge having a vertical fastening flange for connecting contiguous bottom wall mold sections along at least one of said opposite sides, and removable end walls attached to said vertical flanges along said opposite ends of said bottom wall mold section.

5. The moveable building concrete floor mold of claim 4 and a removable side wall is attached to said vertical flange along one of said opposite sides of said bottom wall mold section.

6. The moveable building concrete floor mold of claim 4 and a rod extends over said channel wall and releasably connects said removable end walls at opposite ends of said bottom wall mold section.

7. The moveable building concrete floor mold of claim 4 wherein sleeves extend across said channel wall between said removable end walls and said raised central wall which are adapted to be immersed in concrete and receive lift pins for raising and lowering said concrete floor.

8. The moveable building concrete floor mold of claim 4 and one of said removable end walls includes a horizontally inwardly extending flange to which a detachable building wall base plate is connected, said horizontally inwardly extending flange is positioned over said channel and said building wall base plate is raised above said horizontally inwardly extending flange to provide a concrete ledge and building wall fastening means when said concrete is poured under said horizontally inwardly extending flange and under said building wall base plate.

9. The moveable building concrete floor mold of claim 4 wherein said vertical fastening flange extends downwardly below said channel wall.

10. The moveable building concrete floor mold of claim 7 wherein said sleeves include two sleeves extending over said channel wall at each end of said bottom wall mold section, said two sleeves each being supported on a horizontal leg of an L-shaped bracket on said channel wall, said L-shaped bracket for each sleeve having a vertical leg, reinforcing rods extend through said vertical legs of each L-shaped bracket and are positioned above said channel wall.

11. The moveable building concrete floor mold of claim 10 wherein said sleeves and said reinforcing rods extend at right angles to each other.

12. The moveable building concrete floor mold of claim 11 wherein each of said sleeves is integrally connected to said L-shaped bracket.

* * * * *